US008600254B2

(12) United States Patent
Kinouchi et al.

(10) Patent No.: US 8,600,254 B2
(45) Date of Patent: Dec. 3, 2013

(54) FIXING DEVICE

(75) Inventors: Satoshi Kinouchi, Tokyo (JP); Toshihiro Sone, Kanagawa (JP); Ryota Saeki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 260 days.

(21) Appl. No.: 13/104,879

(22) Filed: May 10, 2011

(65) Prior Publication Data

US 2011/0287358 A1 Nov. 24, 2011

Related U.S. Application Data

(60) Provisional application No. 61/346,341, filed on May 19, 2010.

(51) Int. Cl.
*G03G 15/20* (2006.01)

(52) U.S. Cl.
USPC ..... 399/70; 399/329; 219/216

(58) Field of Classification Search
USPC ..... 399/70, 329
See application file for complete search history.

(56) References Cited

U.S. PATENT DOCUMENTS 7,386,243 B2 6/2008 Kinouchi et al.
7,620,336 B2 11/2009 Yura et al.
2008/0112720 A1* 5/2008 Kagawa ..... 399/69
2008/0285996 A1 11/2008 Kinouchi et al.
2011/0076043 A1 3/2011 Kikuchi et al.

FOREIGN PATENT DOCUMENTS

JP 08-069190 3/1996
JP 09-026716 1/1997

OTHER PUBLICATIONS

U.S. Appl. No. 12/951,791, filed Nov. 22, 2010, entitled Fixing Device Including Auxiliary Heat Generating Member Comprising Region Wider Than Heat Generation Region.

U.S. Appl. No. 12/951,931, filed Nov. 22, 2010, entitled Fixing Device Comprising Auxiliary Heat Generating Member and Maintaining Gap Relative to Separator.

U.S. Appl. No. 13/033,556, filed Feb. 23, 2011, entitled Fixing Device.

* cited by examiner

*Primary Examiner* — Walter L Lindsay, Jr.
*Assistant Examiner* — Benjamin Schmitt
(74) *Attorney, Agent, or Firm* — Patterson & Sheridan, LLP

(57) ABSTRACT

A fixing device includes a fixing belt including a metal layer, a pressing member to form a nip between the pressing member and the fixing belt, an induction current generating coil that faces an outer periphery of the fixing belt, and heats the fixing belt located at a nip position through a hollow inside of the fixing belt, and a coil controller supplies a high frequency to the induction current generating coil.

14 Claims, 5 Drawing Sheets

FIXING DEVICE

CROSS-REFERENCE TO RELATED APPLICATION

This application is based upon and claims the benefit of priority from Provisional U.S. Application 61/346,341 filed on May 19, 2010, the entire contents of which are incorporated herein by reference.

FIELD

Embodiments described herein relate generally to a fixing device used in an electrophotographic image forming apparatus and for fixing a toner image by using induction heating.

BACKGROUND

As a fixing device used for an electrophotographic image forming apparatus such as a copying machine or a printer, there is a device for heating a fixing belt having low heat capacity by an induction current generating coil. In the fixing device using the fixing belt, warm-up time is shortened, electric power at the time of fixing is reduced, and energy is saved. Among fixing devices using fixing belts, there is a fixing device in which an induction current generating coil provided in the inside of a fixing belt heats a nip part of the fixing belt in order to efficiently heat the nip part of the fixing belt.

However, when the induction current generating coil is disposed in the inside of the fixing belt, the induction current generating coil itself becomes the heat capacity. Finally, the induction current generating coil is heated to almost the same temperature as the temperature of the fixing belt. Thus, the energy to heat the induction current generating coil becomes wasted, and there is a fear that the shortening of the warm-up time is prevented.

DETAILED DESCRIPTION

According to an embodiment, a fixing device includes a fixing belt including a metal layer, a pressing member to form a nip between the pressing member and the fixing belt, an induction current generating coil that faces an outer periphery of the fixing belt, and heats the fixing belt located at a nip position through a hollow inside of the fixing belt, and a coil controller supplies a high frequency to the induction current generating coil.

Hereinafter, embodiments will be described.

First Embodiment

Figure 1:
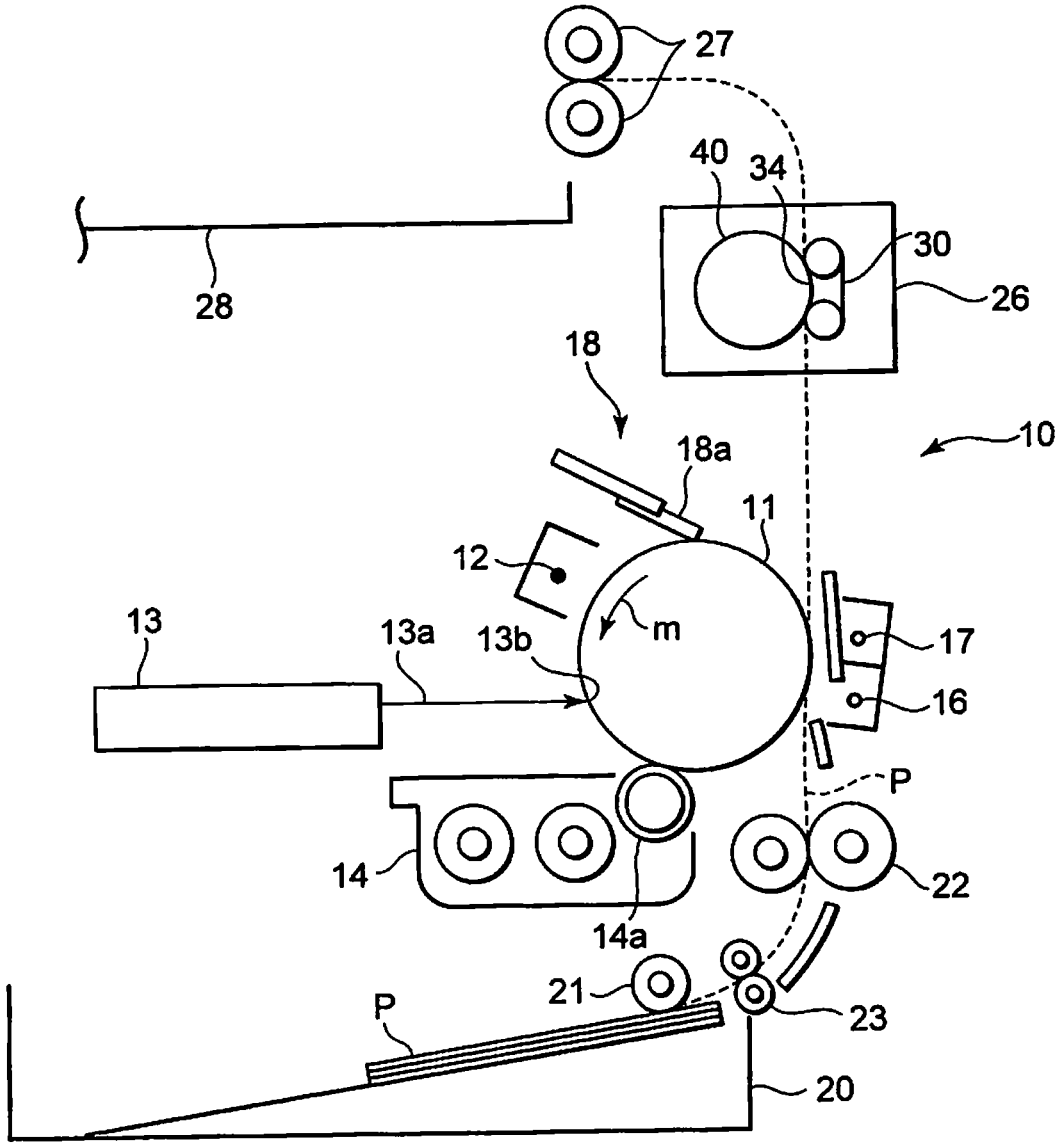
FIG. 1 is a schematic structural view showing a main part of a printer of a first embodiment.

FIG. 1 shows a main part of a printer 10 as an image forming apparatus of a first embodiment. In the printer 10, a charger 12, an exposure device 13, a developing device 14, a transfer charger 16, a peeling charger 17 and a cleaner 18 are provided around a photoconductive drum 11 rotating in an arrow m direction. The charger 12 uniformly charges the photoconductive drum 11. The exposure device 13 irradiates a laser light 13*a* to an exposure position 13*b* of the uniformly charged photoconductive drum 11 based on image data, and the like and forms an electrostatic latent image on the photoconductive drum 11. The developing device 14 supplies toner to the electrostatic latent image on the photoconductive drum 11 by a developing roller 14*a* and visualizes the electrostatic latent image.

The transfer charger 16 transfers a toner image formed on the photoconductive drum 11 to a sheet P as a recording medium, and the peeling charger 17 peels the sheet P, on which the toner image is transferred, from the photoconductive drum 11. The cleaner 18 cleans toner remaining on the photoconductive drum 11 after the transfer by a cleaning blade 18*a*. The sheet P is taken out from a paper feed cassette 20 by a pickup roller 21. The sheet P taken out from the paper feed cassette 20 is conveyed to a separating roller 23 and a register roller 22, and reaches to the transfer charger 16 in synchronization with the toner image formed on the photoconductive drum 11.

The printer 10 includes, at the downstream side of the peeling charger 17 in the conveyance direction of the sheet P, a fixing unit 26 to heat, press and fix the toner image on the sheet P and a paper discharge roller 27 to discharge the sheet P after the fixing to a paper discharge part 28. A main body CPU 50 controls the whole printer 10 including a controller 60 of an IH coil 36 described later.

In the printer 10, when image formation starts, after the charger 12 charges the photoconductive drum 11 rotating in the arrow m direction, the laser exposure device 13 irradiates the laser light 13*a* to the photoconductive drum 11 and forms the electrostatic latent image on the photoconductive drum 11. In the printer 10, the developing device 14 supplies toner to the electrostatic latent image on the photoconductive drum 11, and forms the toner image. The transfer charger 16 transfers the toner image on the photoconductive drum 11 to the sheet P. After the transfer is ended, in the printer 10, the peeling charger 17 peels the sheet P from the photoconductive drum 11. The fixing unit 26 fixes the toner image to the sheet P. After the toner image is fixed, in the printer 10, the paper discharge roller 27 discharges the sheet P to the paper discharge part 28.

Figure 2:
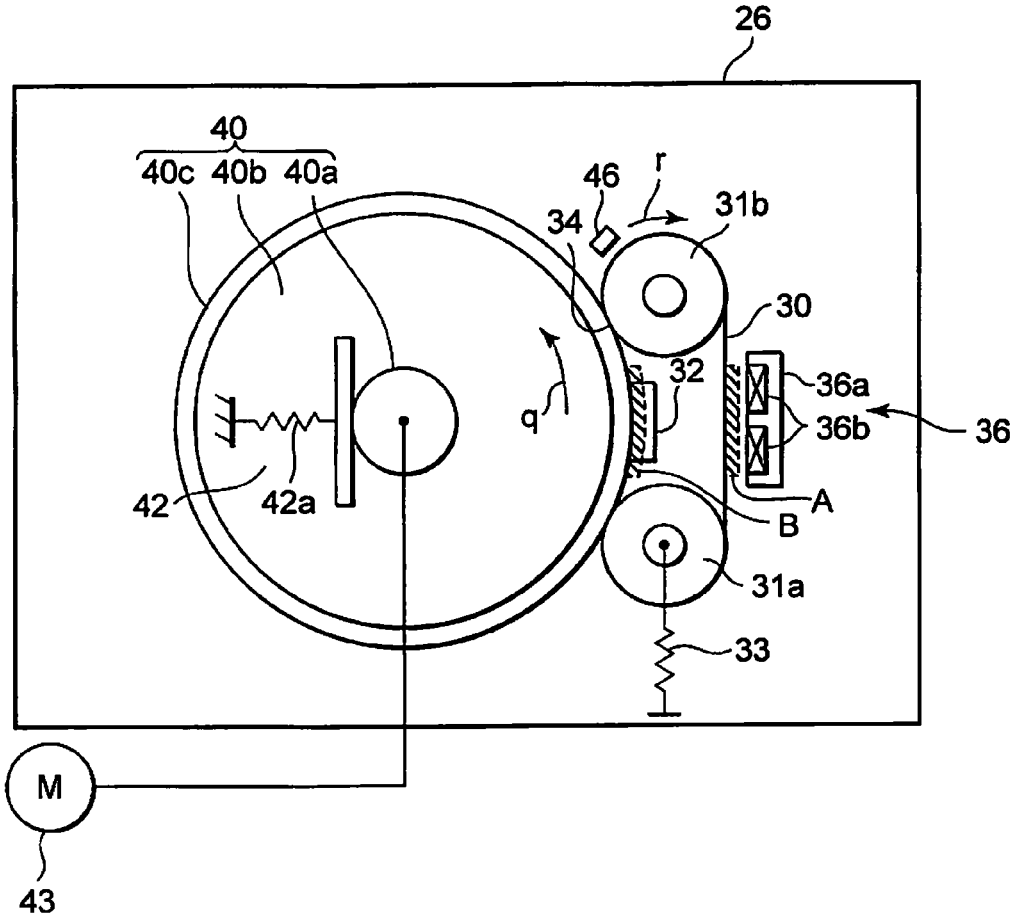
FIG. 2 is a schematic structural view showing a fixing unit of the first embodiment.

Next, the fixing unit 26 will be described in detail. As shown in FIG. 2, the fixing unit 26 includes a fixing belt 30, an induction current generating coil (hereinafter abbreviated to IH coil) 36, a pressing roller 40 as a pressing member, and a non-contact infrared temperature sensor 46 of, for example, a thermopile type.

Figure 3:
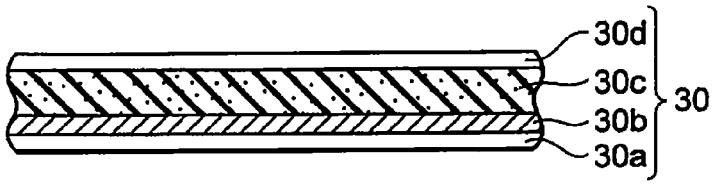
FIG. 3 is a schematic explanatory view showing a layer structure of a fixing belt of the first embodiment.

For example, as shown in FIG. 3, the fixing belt 30 includes a metal layer 30*b*, a solid rubber layer 30*c* and a release layer 30*d*, which are provided on a support layer 30*a*. The metal layer 30*b* is made of, for example, nickel (Ni) of a thickness of 40 μm. The metal layer 30*b* may be made of stainless steel, aluminum (Al), or a compound material of stainless steel and aluminum. The solid rubber layer 30*c* is made of a silicon rubber layer of a thickness of 200 μm. The release layer 30*d* is made of PFA (polytetra-fluoroethylene) of a thickness of 30 μm. The fixing belt 30 is supported by support rollers 31*a* and 31*b*. The support rollers 31*a*, 31*b* include, for example, a core metal, a heat resistant sponge layer around the core metal, and a release layer of PFA at the surface. The fixing belt 30 acquires a desired tension by a tension mechanism 33 acting on the support roller 31*a*.

The fixing unit 26 includes, in a hollow inside of the fixing belt 30, a pressing pat 32 as a nip forming member to press the fixing belt 30 to the pressing roller 40. The pressing pat 32 is made of, for example, heat resistant silicone sponge having no conductivity, and includes a release layer of, for example, PFA at the surface. Both sides of the pressing pat 32 in the longitudinal direction are supported by, for example, a heat insulating support member.

The pressing roller 40 includes, for example, a core metal 40*a*, a foamed rubber (sponge) layer 40*b* around the core metal, and a PFA tube 40*c* coated on the surface. The fixing unit 26 includes a pressing mechanism 42 having a spring 42*a* to press the pressing roller 40 to the pressing pat 32. The pressing roller 40 pressed by the spring 42*a* forms a nip 34 having a specific width between the pressing roller 40 and the fixing belt 30 at the position of the pressing pat 32. The pressing roller 40 rotates in an arrow q direction by a drive motor 43. The fixing belt 30 is driven by the pressing roller 40 and rotates in an arrow r direction.

The IH coil 36 is disposed at an outer periphery of the fixing belt 30. The IH coil 36 is located at the outer periphery of the fixing belt 30, and is opposite to the nip 34 through the hollow part of the fixing belt 30. The IH coil 36 is formed by winding a copper wire rod 36*b* around a magnetic core 36*a*. The magnetic core 36*a* strengthens the magnetic force of the IH coil 36 and concentrates the magnetic flux to the fixing belt 30. The copper wire rod 36*b* is for example a litz wire in which 16 copper wire rods each having a diameter of 0.5 mm are bundled. When the copper wire rod 36*b* is made the litz wire, the diameter of the copper wire rod 36*b* can be made smaller than the penetration depth of the magnetic field. By this, a high frequency current can be made to effectively flow through the copper wire rod 36*b*.

Figure 4:
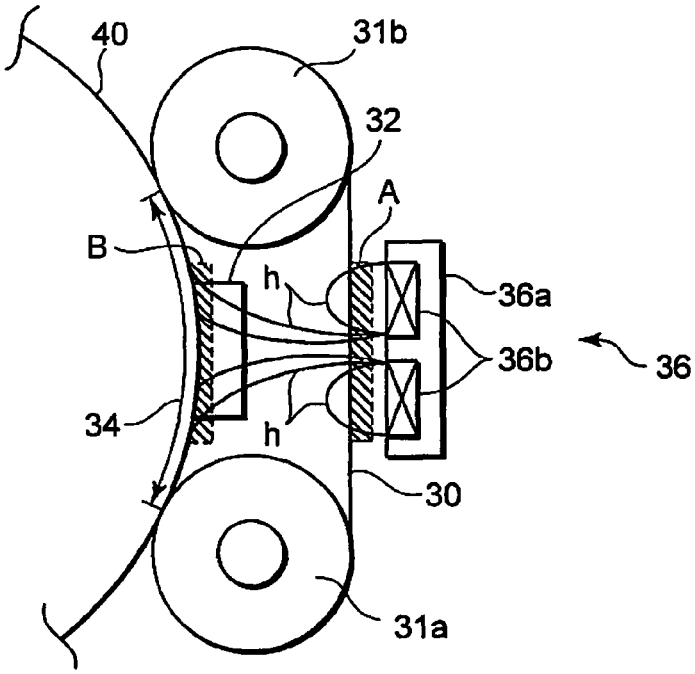
FIG. 4 is a schematic explanatory view showing a magnetic flux generated by an IH coil of the first embodiment.

When the high frequency current is supplied to the copper wire rod 36*b*, the IH coil 36 generates a magnetic flux h shown in FIG. 4. The magnetic flux h generates an eddy-current as induced current so as to prevent the change of the magnetic field mainly in the metal layer 30*b* of an area A and an area B of the fixing belt 30. Joule heat is generated by the eddy-current and the resistance of the metal layer 30*b*, and the fixing belt 30 is instantaneously heated. The area A of the fixing belt 30 is the area near the IH coil 36. The area B of the fixing belt 30 is the area at the nip 34 side.

In the IH coil 36, the frequency of the high frequency current supplied to the copper wire rod 36*b* is changed to change the ratio of heating of the area A of the fixing belt 30 and heating of the area B of the fixing belt 30. That is, when the frequency of the high frequency current supplied to the copper wire rod 36*b* is high, the magnetic flux is concentrated to the area A near the IH coil 35 by a skin effect, and the magnetic flux h passing through the area A decreases. When the frequency of the high frequency current supplied to the copper wire rod 36*b* is low, the magnetic flux h passing through the area A is increased. Accordingly, when the frequency of the high frequency current supplied to the copper wire rod 36*b* is increased, the ratio of heating of the area A by the IH coil 36 becomes high. When the frequency of the high frequency current supplied to the copper wire rod 36*b* is decreased, the ratio of heating of the area B by the IH coil 36 becomes high.

Figure 5:
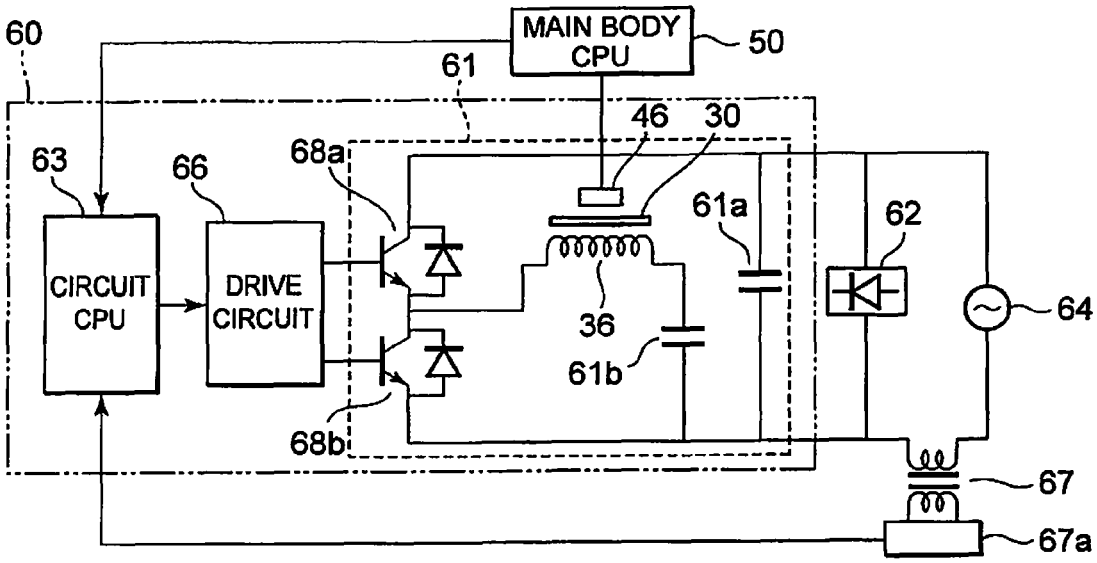
FIG. 5 is a schematic block diagram showing a controller of the IH coil of the first embodiment.

Next, the controller 60 of the IH coil 36 to heat the fixing belt 30 will be described. As shown in FIG. 5, the controller 60 includes an inverter circuit 61 to supply the high frequency current to the IH coil 36, a rectifier circuit 62 to supply DC current to the inverter circuit 61, a circuit CPU 63 as a coil controller to control the electric power of the rectifier circuit 62 and to control the frequency of the high frequency current supplied to the IH coil 36, the electric power and on and off, and a drive circuit 66 to drive the inverter circuit 61. Incidentally, the operation performed by the circuit CPU 63 may be performed by the main body CPU 50.

The rectifier circuit 62 converts AC power from a commercial AC power source 64 into DC power. The controller 60 includes a transformer 67 at a front stage of the rectifier circuit 62, and detects all power consumption through an input detection part 67*a*. The circuit CPU 63 obtains power, which can be supplied to the IH coil 36, from all power consumption detected by the input detection part 67*a*, and feedback controls the IH coil 36.

The inverter circuit 61 uses, for example, a self-excited half-bridge (current resonance) inverter. The inverter circuit 61 includes a first capacitor 61*a* for oscillation connected in parallel to the IH coil 36 and a second capacitor 61*b*. The inverter circuit 61 includes a first switching element 68*a* connected to the first capacitor 61*a* and a second switching element 68*b* connected to the second capacitor 61*b*. As the two switching elements 68*a* and 68*b*, for example, an IGBT, a MOS-FET or the like used in high-voltage and high-current is used.

The circuit CPU 63 controls the drive circuit 66, and control the ON time of each of the two switching elements 68*a* and 68*b*. The two switching elements 68*a* and 68*b* are alternately turned on and off by the drive circuit 66, and a high frequency current having a desired drive frequency is supplied to the IH coil 36. For example, the on time of the first switching element 68*a* is fixed, and the on time of the second switching element 68*b* is changed, so that the high frequency current is set to the desired drive frequency. The controller 60 changes the frequency of the high frequency current supplied to the IH coil 36 in the range of 20 to 100 kHz while the power is kept constant, and changes the skin depth in which the magnetic flux by the IH coil 36 is concentrated to the fixing belt 30.

When the power source of the printer 10 is turned on, the main body CPU 50 starts warm-up control of the fixing unit 26. The fixing unit 26 starts the warm-up by the instruction from the main body CPU 50. By the instruction from the main body CPU 50, the circuit CPU 63 changes the on time of the second switching element 68*b* and sets, for example, the frequency of the high frequency current supplied to the IH coil 36 to be as low as 30 kHz.

When the high frequency current of 30 kHz is applied to the IH coil 36, in the magnetic flux generated by the IH coil 36, the ratio of the magnetic flux, which passes through the area A of the fixing belt 30 and reaches to the area B of the fixing belt 30 through the hollow inside of the fixing belt 30, becomes large. That is, the eddy-current is generated in the area A of the fixing belt 30 and the area B at the nip position by the magnetic flux generated by the IH coil 36. The metal layer 30*b* of the fixing belt 30 in the area A and the area B is directly heated by the magnetic flux generated by the IH coil 36. Further, since the magnetic flux passing through the area A is large, the ratio of heat generation of the area B of the fixing belt 30 becomes high as compared with the area A of the fixing belt 30. The frequency of the high frequency current supplied to the IH coil 36 by the controller 60 is arbitrary, and the frequency is made such that the ratio of heat generation of the area B of the fixing belt 30 is high.

During the warm-up, when the infrared temperature sensor 46 detects that the fixing belt 30 reaches a ready temperature, the main body CPU 50 sets the fixing unit 26 to a ready mode. The main body CPU 50 instructs the circuit CPU 63 of the fixing unit 26 to turn on and off the controller 60 according to the detected temperature of the fixing belt 30 from the infrared temperature sensor 46. When the controller 60 is on during the ready mode, the circuit CPU 63 controls the frequency of the high frequency current supplied to the IH coil 36 to 30 kHz by the instruction from the main body CPU 50. At the time of the ready mode, a large part of the magnetic flux generated by the IH coil 36 passes through the area A of the fixing belt 30, and reaches to the area B of the fixing belt 30 through the hollow inside of the fixing belt 30. In the fixing belt 30, the metal layer 30*b* in the area B at the nip position is heated at a high ratio as compared with the area A by the magnetic flux generated by the IH coil 36, and the ready temperature is kept.

When printing starts, the main body CPU 50 sets the fixing unit 26 to a print mode. The circuit CPU 63 controls the frequency of the high frequency current supplied to the IH coil 36 to 30 kHz by the instruction from the main body CPU 50. At the time of the print mode, a large part of the magnetic flux generated by the IH coil 36 passes through the area A of the fixing belt 30 and reaches to the area B of the fixing belt 30 through the hollow inside of the fixing belt 30. In the fixing belt 30, the metal layer 30*b* in the area B at the nip position is heated at a high ratio as compared with the area A by the magnetic flux generated by the IH coil 36, and the fixing temperature is kept. In the fixing unit 26, the sheet P having the toner image passes through the nip 34 between the fixing belt 30 and the pressing roller 40, and the toner image is heated, pressed and fixed to the sheet P.

According to the first embodiment, in the fixing unit 26, the controller 60 supplies the high frequency current of low frequency to the IH coil 36. A large part of the magnetic flux generated by the IH coil 36 reaches to the area B of the fixing belt 30, and directly heats the metal layer 30*b* in the area B at the nip position at a high ratio as compared with the area A. Accordingly, since the fixing unit 26 can directly and quickly control the temperature of the fixing belt 30 at the nip position, the temperature control delay of the fixing belt 30 is prevented. The fixing unit 26 reduces the energy released from the fixing belt 30 until the fixing belt 30 located in the area A reaches to the nip position, and the energy is saved, and the warm-up time of the fixing belt is further shortened. In the fixing unit 26, since the IH coil 36 is not disposed in the hollow inside of the fixing belt 30, the fixing belt 30 can be miniaturized.

Second Embodiment

A second embodiment is different from the first embodiment in that the ratio of heat generation in the area A and the area B of the fixing belt 30 by the IH coil 36 is changed. In the second embodiment, the same structure as the structure explained in the first embodiment is denoted by the same reference numeral and its detailed explanation is omitted.

Figure 6:
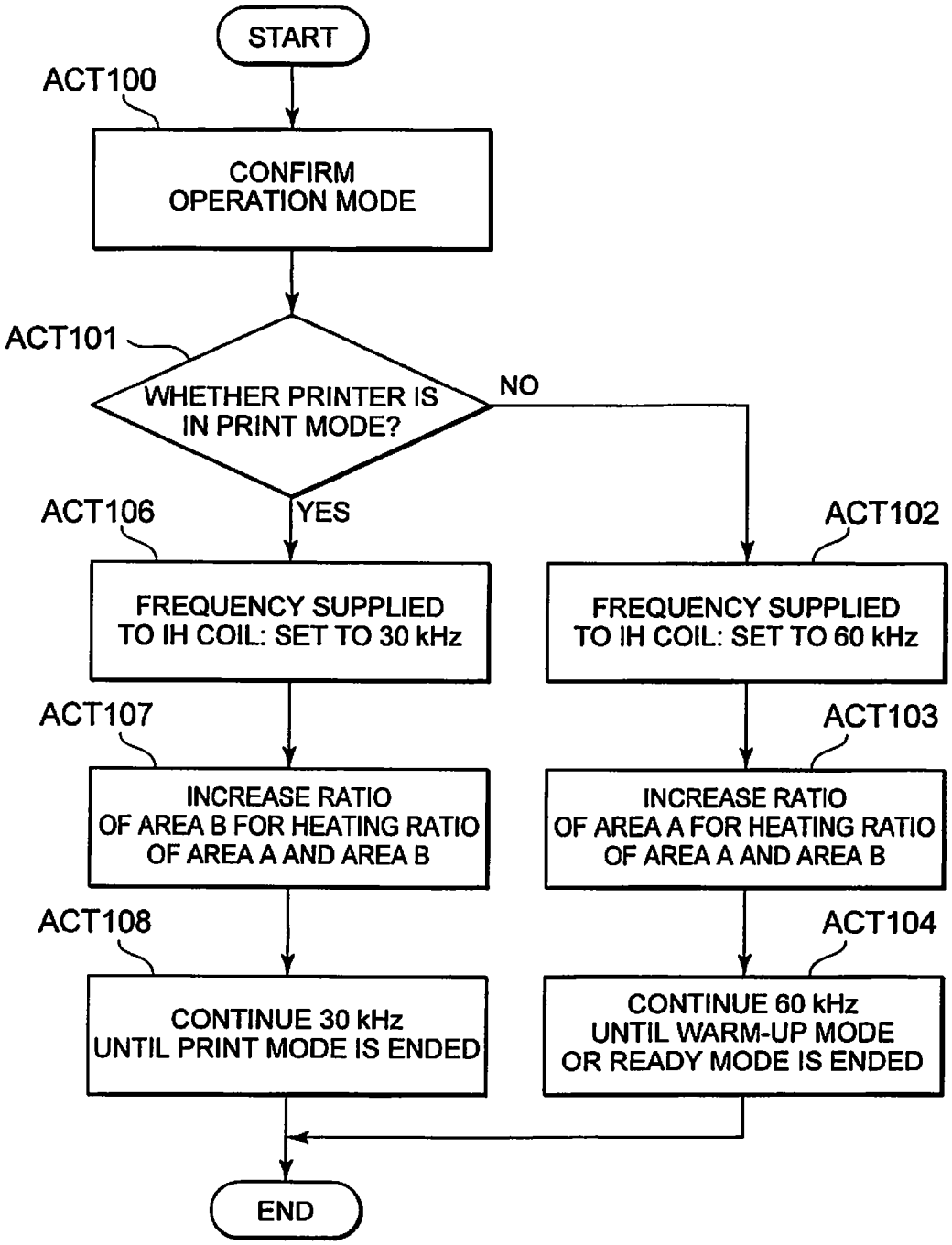
FIG. 6 is a flowchart showing control of a frequency of an IH coil of a second embodiment.

In the second embodiment, in accordance with an operation mode of a printer 10, a controller 60 changes the frequency of high frequency current supplied to the IH coil 36, and changes the ratio of heat generation of the area A and the area B of the fixing belt 30. A main body CPU 50 controls a circuit CPU 63 according to the operation mode in accordance with a flowchart of FIG. 6. The main body CPU 50 starts the control of the controller 60, and confirms the operation mode of the printer 10 (ACT 100). The main body CPU 50 determines at ACT 101 whether the printer 10 is in a print mode.

When the printer 10 is in a warm-up mode or a ready mode (No at ACT 101), the main body CPU 50 advances to ACT 102. At ACT 102, the main body CPU 50 sets the frequency of the high frequency current supplied to the IH coil 36 to 60 kHz. The circuit CPU 63 adjusts the on time of a second switching element 68*b* by the instruction from the main body CPU 50, so that the frequency of the high frequency current supplied to the IH coil 36 is set to 60 kHz. The controller 60 applies the high frequency current of the frequency of 60 kHz to the IH coil 36.

The frequency applied to the IH coil 36 is set to 60 kHz. As compared with the time of 30 kHz, the magnetic flux concentrated to the area A of the fixing belt 30 is increased, and the magnetic flux, which passes through the area A of the fixing belt 30 and reaches to the area B of the fixing belt 30, is decreased. That is, as compared with the case where the high frequency current of the frequency of 30 kHz is applied to the IH coil 36, the high frequency current of 60 kHz is applied to the IH coil 36, and the ratio of heating of the area A of the fixing belt is increased (ACT 103). Thereafter, the main body CPU 50 instructs the circuit CPU 63 to keep the frequency at 60 kHz until the printer 10 ends the warm-up mode or the ready mode (ACT 104).

When the printer 10 is in the print mode at ACT 101 (Yes at ACT 101), the main body CPU 50 advances to ACT 106. At ACT 106, the main body CPU 50 sets the frequency of the high frequency current supplied to the IH coil 36 to 30 kHz. The circuit CPU 63 adjusts the on time of the second switching element 68*b* by the instruction from the main body CPU 50, so that the frequency of the high frequency current supplied to the IH coil 36 is set to 30 kHz. The controller 60 applies the high frequency current of the frequency of 30 kHz to the IH coil 36.

The frequency applied to the IH coil 36 is set to 30 kHz, and as compared with the time of 60 kHz, the magnetic flux, which passes through the area A of the fixing belt 30 and reaches to the area B of the fixing belt 30 through the hollow inside of the fixing belt 30, is increased. That is, as compared with the case where the high frequency current of the frequency of 60 kHz is applied to the IH coil 36, the high frequency current of the frequency of 30 kHz is applied to the IH coil 36, and the ratio of heating of the area B of the fixing belt is increased (ACT 107). Thereafter, the main body CPU 50 instructs the circuit CPU 63 to keep the frequency at 30 kHz until the printer 10 ends the print mode (ACT 108).

Incidentally, the variation value of the frequency of the high frequency current supplied to the IH coil 36 is not limited. The ratio of heating of the area A and the area B of the fixing belt 30 is adjusted according to the operation mode of the printer 10, the number of prints, the kind of the sheet and the like.

According to the second embodiment, similarly to the first embodiment, the fixing unit 26 directly heats the metal layer 30*b* of the fixing belt 30 located at the nip position, so that the temperature of the fixing belt 30 can be directly and quickly controlled at the nip position, and the control delay of the fixing belt 30 is prevented. In the fixing unit 26, the energy is saved, the warm-up time is shortened, and the fixing belt 30 is miniaturized. Further, in the fixing unit 26, the ratio of heating of the area A and the area B can be changed according to various conditions of the printer 10, and a print operation more suitable to various print conditions can be obtained.

Third Embodiment

A third embodiment is different from the first embodiment in a structure of a pressing pat. In the third embodiment, the same structure as the structure explained in the first embodiment is denoted by the same reference numeral and its detailed explanation is omitted.

Figure 7:
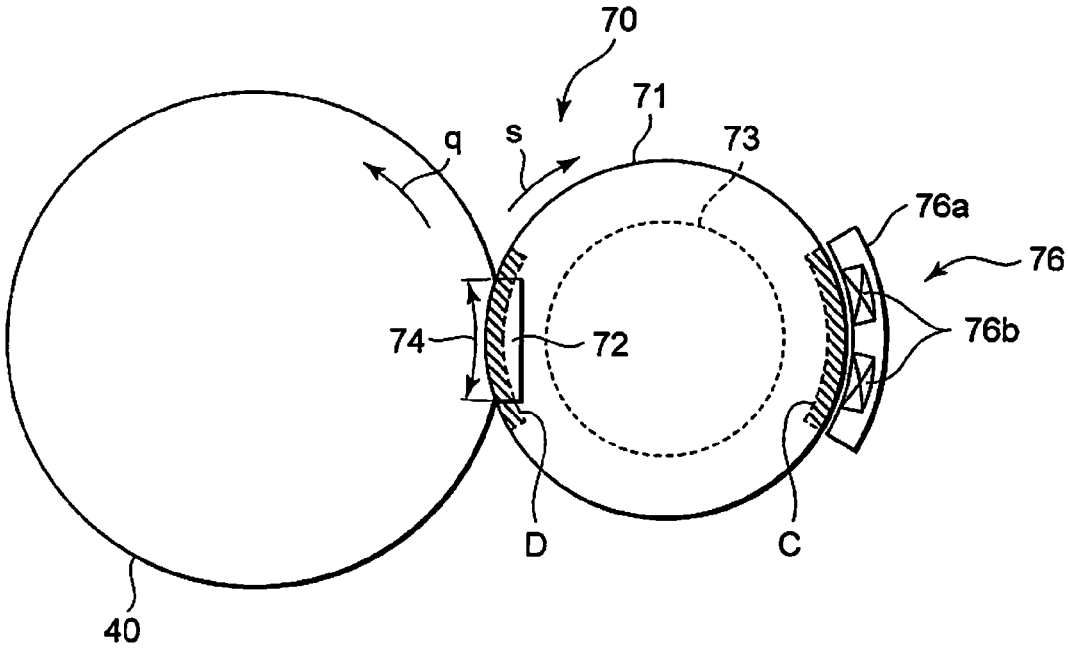
FIG. 7 is a schematic structural view showing a main part of a fixing unit of a third embodiment.

As shown in FIG. 7, a fixing unit 70 includes, in a hollow inside of a fixing belt 71, a pressing pat 72 as a nip forming member to press the fixing belt 71 to a pressing roller 40. The fixing belt 71 has the same layer structure as the fixing belt 30 of the first embodiment. Both sides of the fixing belt 71 are supported by a flange 73, and the fixing belt is, together with the flange 73, driven by the pressing roller 40 and rotates in an arrow direction.

The pressing pat 72 presses the fixing belt 71 to the pressing roller 40 to form a nip 74. The pressing pat is formed of, for example, nickel (Ni) as a metal member having a thickness of 0.5 mm, and includes a coat layer containing glass fiber at the surface. The pressing pat 72 may be such that PFA is coated on iron (Fe) or a metal member is bonded to a heat resistant silicone rubber in a laminar shape.

The fixing unit 70 includes an IH coil 76 along the fixing belt 71 at a position opposite to a nip 74 of an outer periphery of the fixing belt 71. The IH coil 76 is formed by winding a copper wire 76*b* around an arc-shaped magnetic core 76*a*. The magnetic core 76*a* strengthens the magnetic force of the IH coil 76 and concentrates the magnetic flux to the fixing belt 71.

When the high frequency current is supplied to the copper wire 76*b*, the IH coil 76 mainly heats an area C and an area D of the fixing belt 71. The area C of the fixing belt 71 is the area near the IH coil 76. The area D of the fixing belt 71 is the area at the nip 74 side.

When warm-up of the printer 10 starts, the fixing unit 70 starts the warm-up by an instruction from a main body CPU 50. A circuit CPU 63 changes the on time of a second switching element 68*b* by the instruction from the main body CPU 50, so that the frequency of the high frequency current supplied to the IH coil 76 is set to, for example, 30 kHz. When the high frequency current of 30 kHz is applied to the IH coil 76, in magnetic flux generated by the IH coil 76, magnetic flux increases which passes through the area C of the fixing belt 71, through the hollow inside of the fixing belt 71, and reaches to the pressing pat 72 which comes in press contact with the fixing belt 71.

The magnetic flux, which passes through the area C and reaches to the pressing pat 72, generates an eddy-current in the pressing pat 72. Joule heat is generated by the eddy-current and the resistance of the pressing pat 72, and the pressing pat 72 is heated. The generated heat of the pressing pat 72 is transmitted to the fixing belt 71 which contacts with the pressing pat 72 in the area D. That is, the area D of the fixing belt 71 is heated by the pressing pat 72. Further, since the magnetic flux passing through the area C is large, as compared with the ratio of heat generation of the fixing belt 71 in the area C, the ratio of heat generation of the pressing pat 72 becomes high. Thus, in the fixing belt 71, as compared with the area C, the ratio of heating of the area D becomes high.

During a ready mode after the warm-up, when the high frequency current of 30 kHz is applied to the IH coil 76, a large part of the magnetic flux generated by the IH coil 76 passes through the area C of the fixing belt 71, through the hollow inside of the fixing belt 71, and reaches to the pressing pat 72, and heats the pressing pat 72. The generated heat of the pressing pat 72 is transmitted to the fixing belt 71 which contacts with the pressing pat 72 in the area D. By the magnetic flux generated by the IH coil 76, as compared with the heat generation of the area C of the fixing belt 71, the ratio of heat generation of the pressing pat 72 becomes high. Accordingly, in the fixing belt 71, the area D which contacts with the pressing pat 72 is heated at a high ratio as compared with the area C, and the ready temperature is kept.

At the time of the print mode, when the high frequency current of 30 kHz is applied to the IH coil 76, a large part of the magnetic flux generated by the IH coil 76 passes through the area C of the fixing belt 71, through the hollow inside of the fixing belt 71, and reaches to the pressing pat 72, and heats the pressing pat 72. The generated heat of the pressing pat 72 is transmitted to the fixing belt 71 which contacts with the pressing pat 72 in the area D. By the magnetic flux generated by the IH coil 76, as compared with the heat generation of the area C of the fixing belt 71, the ratio of heat generation of the pressing pat 72 becomes high. Accordingly, in the fixing belt 71, the area D which contacts with the pressing pat 72 is heated at a high ratio as compared with the area C, and the fixing temperature is kept.

According to the third embodiment, the pressing pat 72 which contacts with the fixing belt 71 is heated, and the area D of the fixing belt 71 at the nip position is heated. Similarly to the first embodiment, the fixing unit 70 can directly and quickly control the temperature of the fixing belt 71 at the nip position, and prevents the control delay of the fixing belt 71. Besides, the energy is saved, the warm-up time is shortened, and the fixing belt 71 is miniaturized.

According to the fixing device of anyone of the above embodiments, since the induction current generating coil located at the outer periphery of the fixing belt heats the fixing belt at the nip position, the temperature of the fixing belt can be quickly controlled. Besides, the energy is saved, the warm-up time of the fixing unit is shortened, and the fixing belt is miniaturized.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fixing device comprising:

a fixing belt including a metal layer;

a plurality of support rollers supporting the fixing belt;

a pressing member pressing the fixing belt;

an induction current generating coil facing an outer periphery of the fixing belt, and configured to cause a heating of the fixing belt at a nip position formed between the pressing member and the fixing belt; and a coil controller configured to cause a first current to be supplied to the induction current generating coil during a warm-up or a ready mode of an image forming apparatus and a second current to be supplied to the induction current generating coil during a print mode of the image forming apparatus, a frequency of the first current being higher than a frequency of the second current.

2. The fixing device of claim 1, wherein the induction current generating coil is configured to generate an induction current in the metal layer of the fixing belt at the nip position to cause the heating.

3. The fixing device of claim 1, further comprising: a nip forming member including a metal member and configured to urge the fixing belt towards the pressing member from an inside of the fixing belt at the nip position.

4. The fixing device of claim 3, wherein the induction current generating coil is configured to generate an induction current in the metal member of the nip forming member to cause a heating of the metal member.

5. The fixing device of claim 1, wherein the induction current generating coil is further configured to cause a heating of the fixing belt at a position of the fixing belt that is opposite to the nip position.

6. The fixing device of claim 5, wherein the induction current generating coil changes a ratio of a heat generated at the nip position of the fixing belt with respect to a heat quantity generated at the opposite position of the fixing belt, by changing the frequency of the current supplied to the induction current generating coil.

7. The fixing device of claim 5, wherein if a ratio of a heat generated at the nip position of the fixing belt with respect to a heat generated at the opposite position of the fixing belt is to be increased, the coil controller causes the first current to be supplied to the induction current generating coil, and if the ratio is to be decreased, the coil controller causes the second current to be supplied to the induction current generating coil.

8. An image forming apparatus, comprising:

an image transferring unit configured to transfer an image on a recording medium;

a fixing belt including a metal layer;

a plurality of support rollers supporting the fixing unit;

a pressing member pressing the fixing belt and configured to convey the recording medium, between the pressing member and the fixing belt;

an induction current generating coil facing an outer periphery of the fixing belt and configured to cause a heating of the fixing belt at a nip position formed between the pressing member and the fixing belt; and a coil controller configured to cause a first current to be supplied to the induction current generating coil during a warm-up or a ready mode of an image forming apparatus and a second current to be supplied to the induction current generating coil during a print mode of the image forming apparatus, a frequency of the first current being higher than a frequency of the second current.

9. The image forming apparatus of claim 8, wherein the induction current generating coil is configured to generate an induction current in the metal layer of the fixing belt at the nip position to cause the heating.

10. The image forming apparatus of claim 8, wherein the induction current generating coil is further configured to cause a heating of the fixing belt at a position of the fixing belt that is opposite to the nip position.

11. The image forming apparatus of claim 8, wherein if a ratio of a heat generated at the nip position of the fixing belt with respect to a heat generated at the opposite position of the fixing belt is to be increased, the coil controller causes the first current to be supplied to the induction current generating coil, and if the ratio is to be decreased, the coil controller causes the second current to be supplied to the induction current generating coil.

12. A method for fixing an image on a recording medium using a fixing device comprising:

a fixing belt including a metal layer;

a plurality of support rollers supporting the fixing belt;

a pressing member pressing the fixing belt; and an induction current generating coil an outer periphery of the fixing belt, and configured to cause a heating of the fixing belt at a nip position formed between the pressing member and the fixing belt with a magnetic flux, the method comprising:

supplying a first current to the induction current generating coil to cause a first magnetic flux in the fixing belt during a warm-up or a ready mode of an image forming apparatus; and supplying a second current to the induction current generating coil to cause a second magnetic flux in the fixing belt during a print mode of the image forming apparatus, a concentration of the second magnetic flux at the nip position of the fixing belt being higher than a concentration of the first magnetic flux at the nip position of the fixing belt.

13. The method of claim 12, wherein an induction current is generated both at the nip position of the fixing belt and a position of the fixing belt that is opposite to the nip position by the first or the second magnetic fluxes.

14. The method of claim 13, wherein if a ratio of a heat generated at the nip position with respect to a heat generated at the opposite position is to be increased, the first current is supplied to the induction current generating coil, and if the ratio is to be decreased, the second current is supplied to the induction current generating coil.

* * * * *